US008327916B2

(12) United States Patent
Knerr

(10) Patent No.: US 8,327,916 B2
(45) Date of Patent: Dec. 11, 2012

(54) LOW PRESSURE CYLINDER HEAD OUTER DIE COMPONENTS FOR CORE GAS REMOVAL

(75) Inventor: Mark D. Knerr, Wentzville, MO (US)

(73) Assignee: Toyota Motor Engineering & Manufacturing North America (TEMA), Erlanger, KY (US)

( * ) Notice: Subject to any disclaimer, the term of this patent is extended or adjusted under 35 U.S.C. 154(b) by 83 days.

(21) Appl. No.: 12/687,730

(22) Filed: Jan. 14, 2010

(65) Prior Publication Data

US 2011/0168347 A1 Jul. 14, 2011

(51) Int. Cl.
*B22D 17/22* (2006.01)
*B22D 29/00* (2006.01)

(52) U.S. Cl. ..... 164/344; 164/131; 164/132; 164/345

(58) Field of Classification Search ..... 164/131–132, 164/344–345

See application file for complete search history.

(56) References Cited

U.S. PATENT DOCUMENTS

| | | | | |
|---|---|---|---|---|
| 4,695,329 | A | 9/1987 | Hayashi et al. | |
| 4,874,308 | A | 10/1989 | Atlas et al. | |
| 5,022,839 | A | 6/1991 | Brüssel | |
| 5,137,076 | A * | 8/1992 | Takahashi | 164/320 |
| 5,269,364 | A * | 12/1993 | Murata | 164/309 |
| 5,644,833 | A * | 7/1997 | Starkey | 29/527.2 |
| 5,665,281 | A | 9/1997 | Drummond | |
| 5,829,404 | A | 11/1998 | Mori et al. | |
| 7,229,264 | B2 | 6/2007 | Crooks | |
| 7,470,122 | B2 | 12/2008 | Colonico | |

FOREIGN PATENT DOCUMENTS

| | | | |
|---|---|---|---|
| JP | 58-205648 | | 11/1983 |
| JP | 58205648 | A * | 11/1983 |
| JP | 59-109334 | | 6/1984 |
| JP | 1-263010 | | 10/1989 |
| JP | 03000456 | A * | 1/1991 |
| JP | 4-9247 | | 1/1992 |

OTHER PUBLICATIONS

Surface Solutions Maximizing Mold Profits, Mold flyer, Feb. 2009.*
Kazmer, Injection Mold Design and Engineering- 11.2.6-Details Ejector and Related Components, 2007, pp. 276.*

* cited by examiner

*Primary Examiner* — Devang R Patel
(74) *Attorney, Agent, or Firm* — Oblon, Spivak, McClelland, Maier & Neustadt, L.L.P.

(57) ABSTRACT

An apparatus for core gas removal in a low-pressure cylinder head die casting operation includes an upper die, a lower die, an ejector plate disposed above the upper die to eject a part that has been cast, a plurality of tight plugs fastened into cavities formed in the upper die, and a plurality of clean pins attached to the ejector plate, each clean pin corresponding to a location of one of the tight plugs. The clean pins and the tight plugs have matching geometries. The ejector plate lowers to eject a casted cylinder head from the upper die such that a portion of the clean pins extend axially into the tight plugs to clean core gas residue formed on inner walls of the tight plugs during the casting cycle.

17 Claims, 6 Drawing Sheets

LOW PRESSURE CYLINDER HEAD OUTER DIE COMPONENTS FOR CORE GAS REMOVAL

BACKGROUND

1. Field

The embodiments discussed herein relate to a core gas removal device and method and, more particularly, to a core gas extraction method in which cleaning pins attached to an ejector plate remove tar and product gas contaminants from cavities of a die.

2. Description of the Related Art

In an internal combustion engine, the cylinder head is positioned above the cylinders and includes a platform containing part of the combustion chamber and the location of the valves and spark plugs. The cylinder head is important to the performance of the internal combustion engine, as the shape of the combustion chamber, inlet passages and ports determines a major portion of the volumetric efficiency and compression ratio of the engine.

A typical cylinder head for an internal combustion engine is formed by casting. A related casting operation is shown in FIG. 1. During a low pressure cylinder head casting process, core gas is generated inside of the upper die 10 and tight plugs are relied on to vent out the die 10. The core gas tends to cool and condense as tar while travelling through the tight plugs 40. Tar adheres itself to the inner walls of the tight plugs 40 resulting in blocked passages.

Because the tight plugs provide locations for core gas venting in a die, if the tight plugs become clogged, the risk of defects related to trapped core gases increase. Therefore, tight plug passages must remain open for venting.

The related processes to clean the tight plugs relied on an operator to manually clean out tar from the tight plugs on every stroke with a rod. However, the amount of reach required for these operators to clean the tight plugs with a rod resulted in safety violations, and was also inefficient due to the amount of time required for an operator to manually clean the tight plugs.

To address the problems with the manual tight plug cleaning process, an automated process was developed in which cleaning pins attached to the ejector plate lowered into the tight plugs during each part ejection cycle. A tar collection box was used as a central location to collect all tar particles extracted by the clean pins from the tight plugs. The tar collection box was located just above the tight plugs such that the clean pins traveled through the tar collection box during each part ejection stroke. However, large tar build-up was observed around the clean pins caused by tar build up in the tar collection box. This occurred because during each cycle, the cleaning pins moved through the excess tar in the tar collection box. As a result, tar build-up was observed on sides of the clean pins at the end of each part ejection/tight plug cleaning cycle. Excess tar accumulation in the tar collection box prevented proper venting of the core gas through the tight plug, resulting in gas related defects such as misruns and "elephant skin" surface defects on the cylinder head.

Therefore, an improved core gas extraction method is desired in order to overcome the above-described problems.

SUMMARY

It is, therefore, an object to provide a novel and improved method for clean tight plug bushings of upper dies in a low pressure casting process.

Accordingly, there is provided an apparatus for core gas removal in a low-pressure cylinder head die casting operation which includes an upper die, a lower die, an ejector plate disposed above the upper die to eject a part that has been cast, a plurality of tight plugs fastened into cavities formed in the upper die, and a plurality of clean pins attached to the ejector plate, each clean pin corresponding to a location of one of the tight plugs. The clean pins and the tight plugs have matching geometries so that during a part ejection stroke after a casting cycle is complete, the ejector plate lowers to eject a cylinder head from the upper die such that a portion of the clean pins extend axially into the tight plugs to clean core gas residue formed on inner walls of the tight plugs during the casting cycle.

In one exemplary embodiment, the clean pin includes a clean pin body including a succession of at least two cylindrical stepped portions, such that the stepped portions are arranged in order of decreasing diameter along a longitudinal axis of the clean pin and a circular plate-shaped head arranged along the longitudinal axis at an end of the cylinder adjacent to a stepped portion having a largest diameter.

In another exemplary embodiment, sides of the clean pins have a clearance of 1-2 mm from the inner walls of the tight plugs when the clean pins are lowered into the tight plugs.

The objects and advantages of the described embodiments will be realized and achieved by means of the elements and combinations particularly pointed out in the claims.

It is to be understood that both the foregoing general description and the following detailed description are exemplary and explanatory and are not restrictive of the invention, as claimed.

BRIEF DESCRIPTIONS OF THE DRAWINGS

A more complete appreciation of the claimed invention and many of the attendant advantages thereof will be readily obtained as the same becomes better understood by reference to the following detailed description when considered in connection with the accompanying drawings, wherein:

Figure 5:
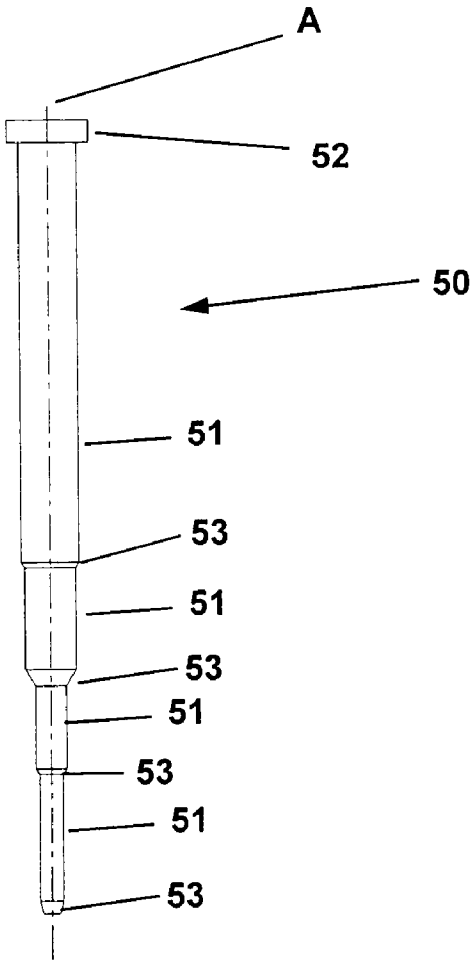
FIG. 5 is a front plan view of the clean pin according to an embodiment of the invention.
Figure 6B:
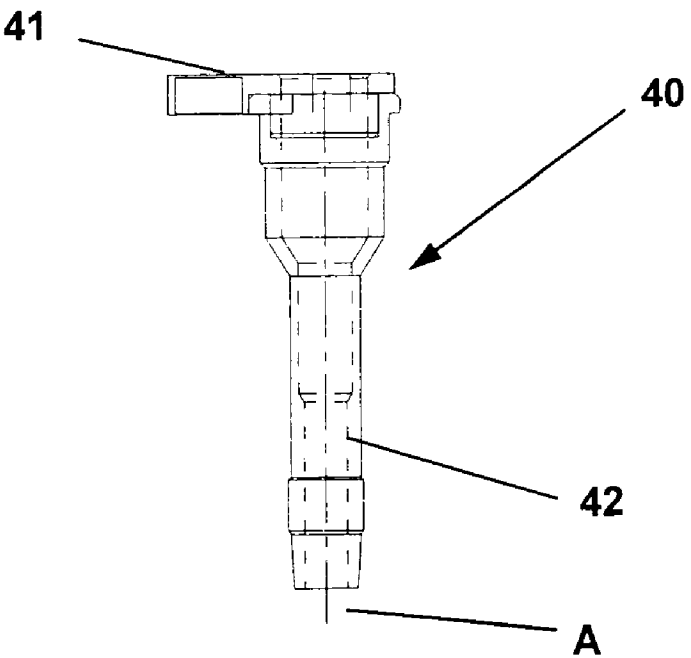
Figure 6A:
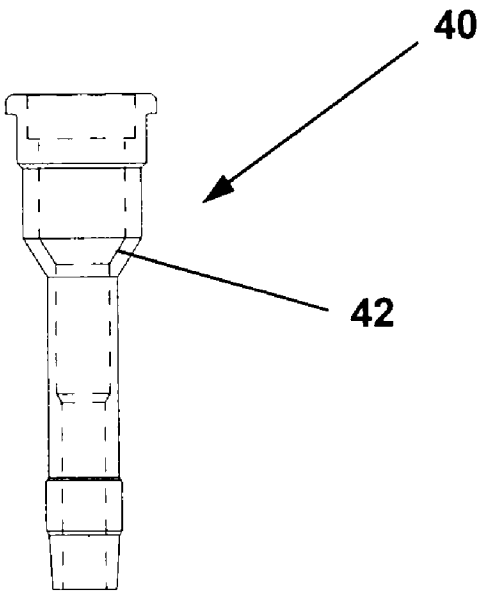

FIG. 6*a* is a plan view of a portion of a tight plug according to an embodiment of the invention; and FIG. 6*b* a tight plug fastener attached to the tight plug shown in FIG. 5*a*.

DETAILED DESCRIPTION OF THE INVENTION

Figure 1:
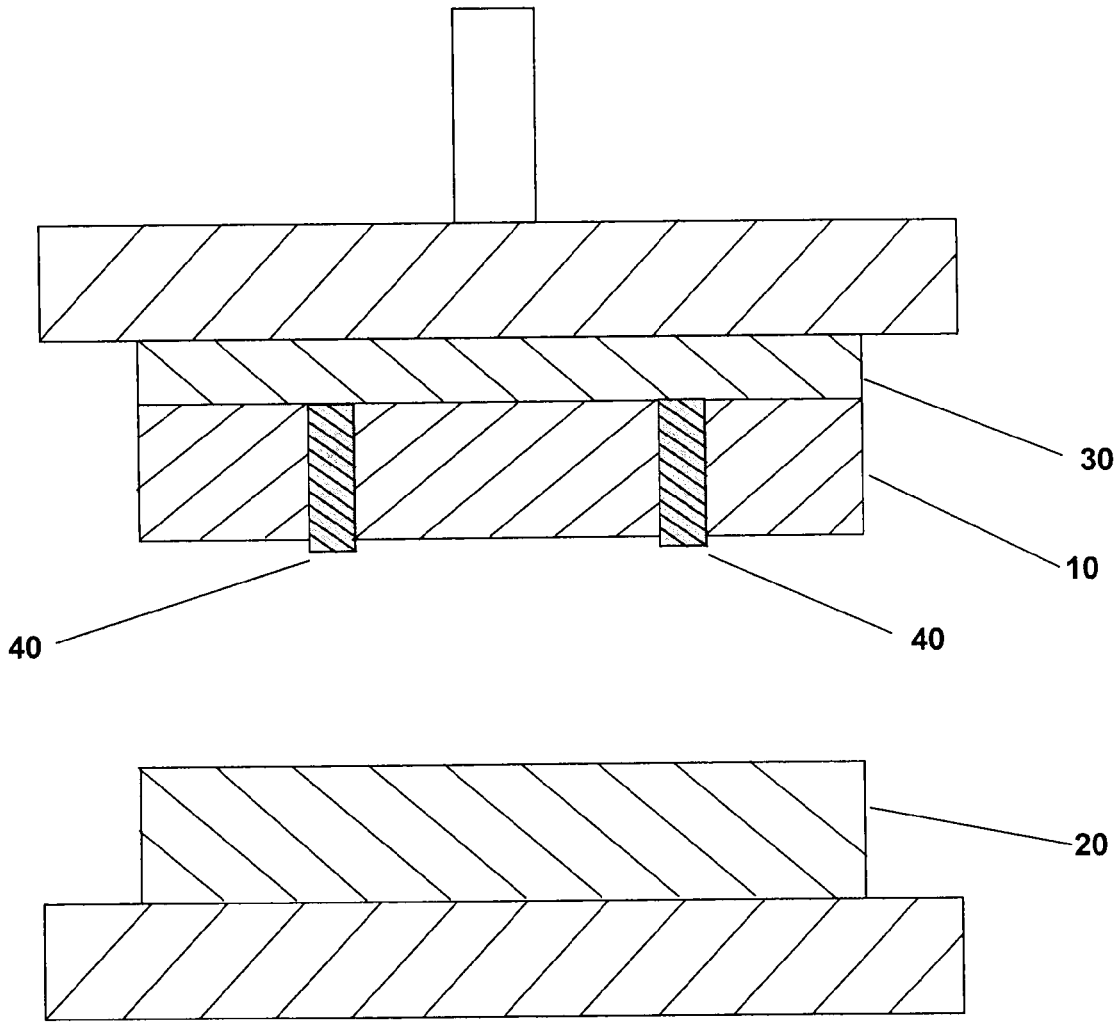
Figure 1 Related Art
FIG. 1 is a schematic sectional view of a conventional low-pressure casting process.

Low pressure casting is a method to apply pressure on a molten metal surface contained in a sealed crucible and raising the molten metal into a mold. The conventional low-pressure casting apparatus 1 shown in FIG. 1 includes an upper die 10, a lower die 20, and an ejector plate 30 positioned above the upper die 10.

The casting may be any desired one of well-known low-pressure metal casting processes. The casting process described in U.S. Pat. No. 4,695,329 is useful in various embodiments of the invention and is hereby incorporated by reference. A sand-based cylinder head core (not shown) is inserted between the upper and lower dies 10, 20 and molten metal (not shown) is filled in between the dies 10, 20 to mold the cylinder head (not shown). The molten metal is supplied only as needed for one casting cycle from a sealed crucible (not shown). In the present invention, the metallic cylinder head is preferably formed of an aluminum alloy in order to reduce the weight of an internal combustion engine. The metal used in the casting operation of the present invention is AC2C (per the Japanese Industrial Standard, "JIS"). AC2C is an aluminum casting alloy which includes Cu in an amount of 2 to 4% by weight, Si in an amount of 5 to 7% by weight, Mg in an amount of 0.2 to 0.4% by weight, Mn in an amount of 0.2 to 0.4% by weight, and a balance of Al. However, the cylinder head of the present invention may be cast from any of casting aluminum alloys traditionally used in the casting of cylinder heads for use in internal combustion engines. Some illustrative, non-limiting examples of the aluminum alloys that may be used include:

- JIS AC2B alloys (Cu 2.0-4.0 wt %, Si 5.0-7.0 wt %, Mg<0.5 wt %, Zn<1.0 wt %, Fe<1.0 wt %, Mn<0.5 wt %, Ni<0.3 wt %, Ti<0.2 wt %, balance Al),
- JIS AC4B alloys (Cu 2.0-4.0 wt %, Si 7.0-10.0 wt %, Mg<0.5 wt %, Zn<1.0 wt %, Fe<1.0 wt %, Mn<0.5 wt %, Ni<0.3 wt %, Ti<0.2 wt %, balance Al), and
- JIS AC4C alloys (Cu<0.2 wt %, Si 6.5-7.5 wt %, Mg 0.20-0.4 wt %, Zn<0.3 wt %, Fe<0.5 wt %, Mn<0.3 wt %, Ti<0.2 wt %, balance Al).

Figure 2:
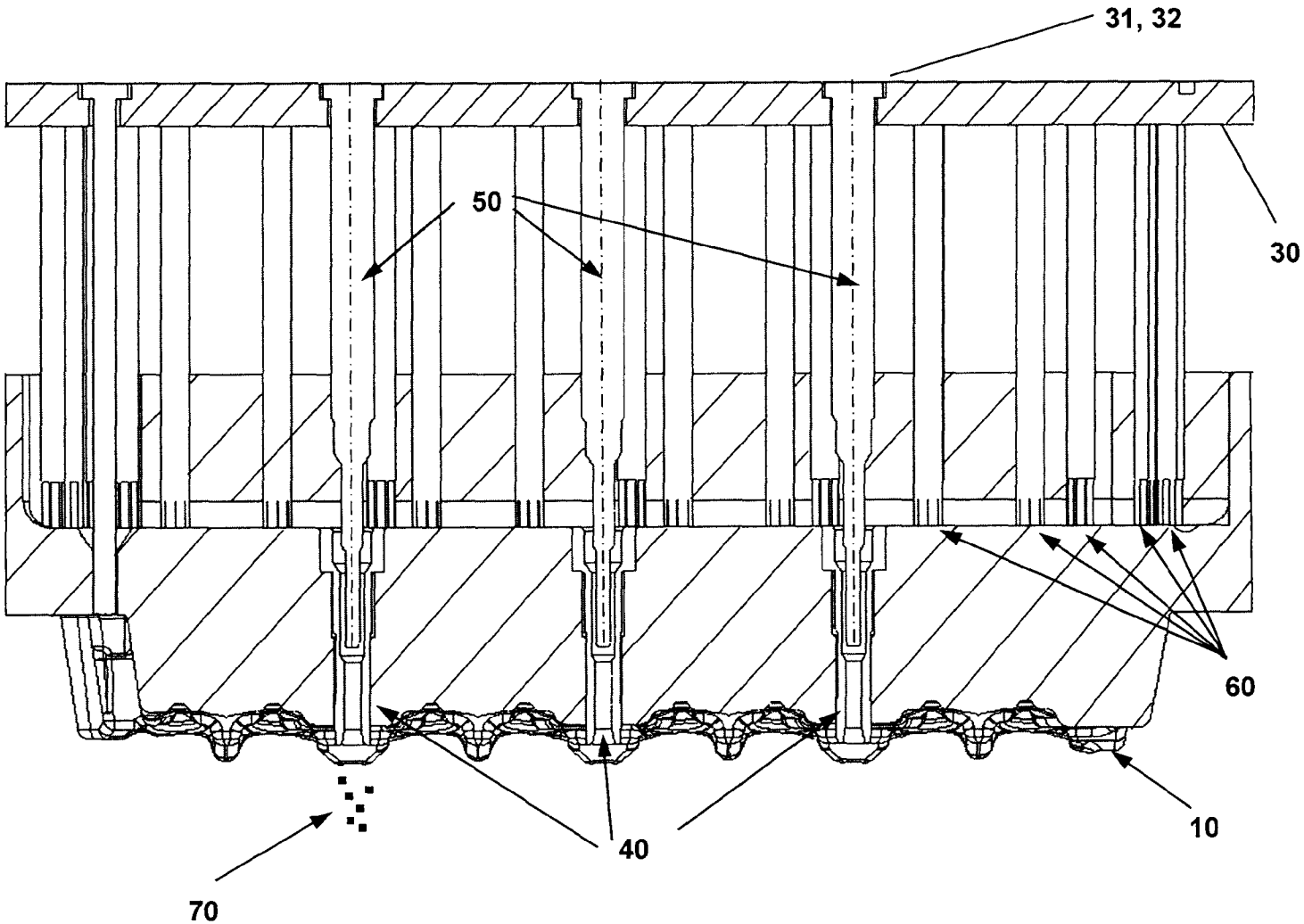
FIG. 2 is a front plan view of the apparatus illustrating a clean pin inserted into a tight plug according to an embodiment of the invention.

As shown in FIG. 2, during the casting cycle, core gas generated from the evaporation of the enclosed core vents upwards through the upper die 10. Tight plugs 40 are inserted into the upper die 10 for venting of the core gas generated by the molten metal evaporating the core. As the core gas rises through the tight plugs 40, the core gas cools and solidifies into tar. Tar particles 70 adhere to the inner walls 42 of the tight plugs 40.

Once the metal casting process has been completed, the apparatus 1 enters a part ejection stroke whereby the cylinder head is ejected from the apparatus 1. As the upper die 10 rises from the lower die 20 after the casting cycle has been completed, the casted cylinder head "sticks" to the upper die 10. This occurs because cylinder heads for use in internal combustion engines generally have a large size and a complicated shape, resulting in a low cooling rate during the casting.

Figure 3:
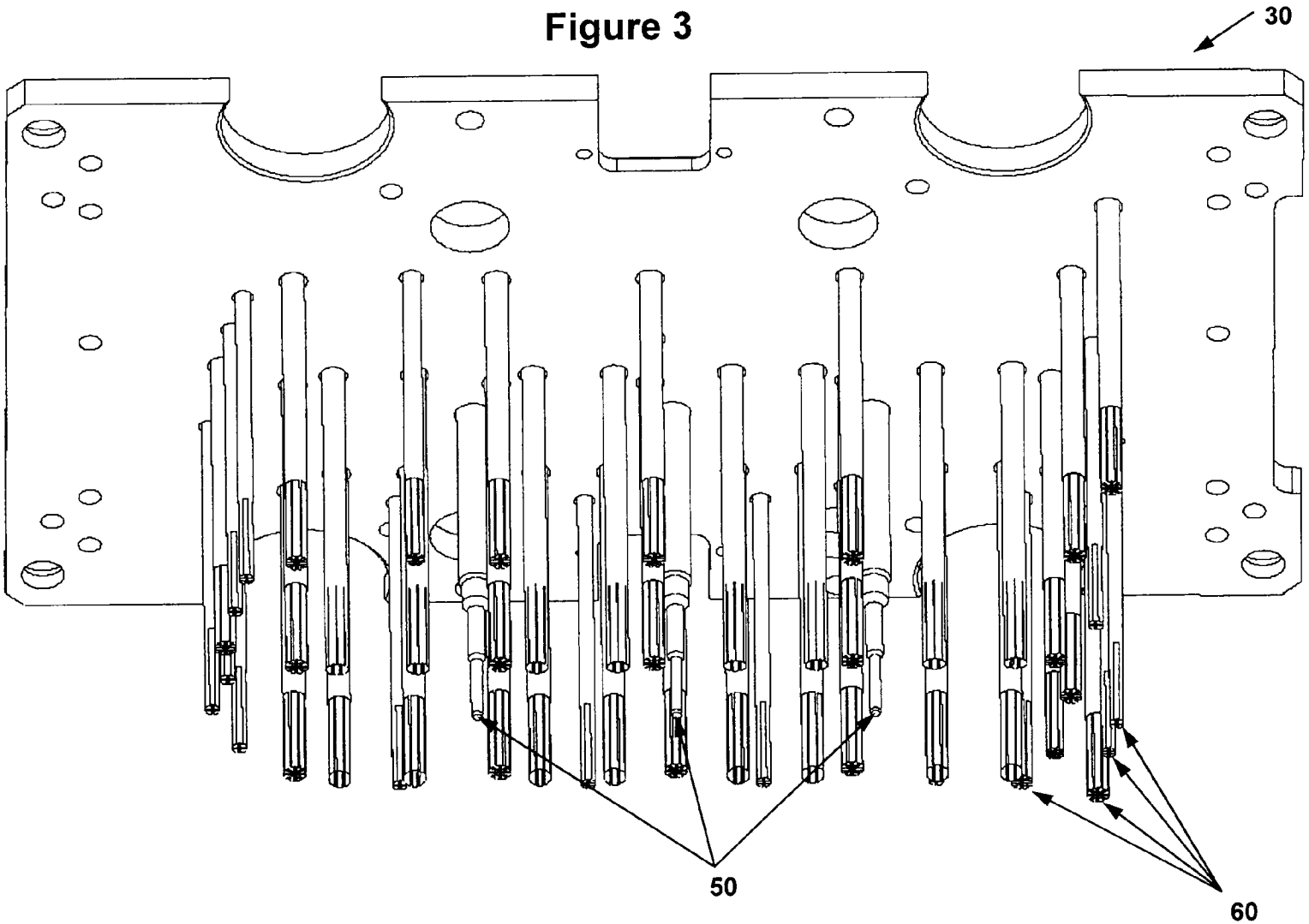
FIG. 3 is a front and bottom elevational view of the ejector plate according to an embodiment of the invention.
Figure 4:
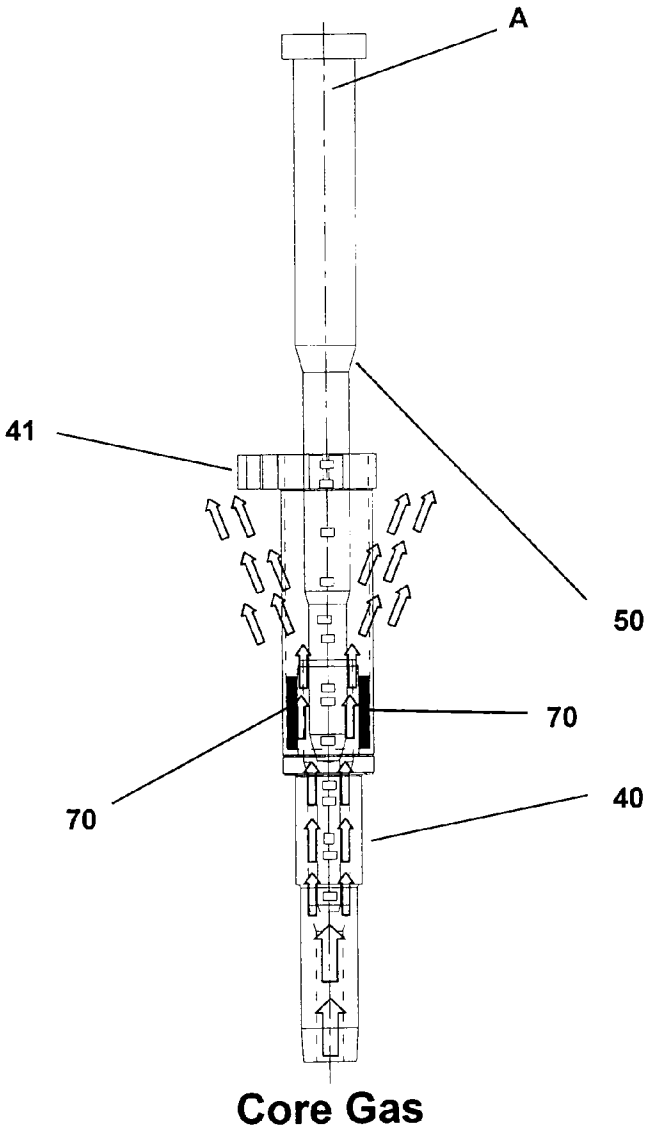
FIG. 4 is a front plan view of a clean pin and tight plug showing core gas travelling through the tight plug during a casting cycle according to an embodiment of the invention.

As illustrated in FIGS. 2 and 3, the ejector plate 30 includes a number of ejector pins 60 to push the cylinder head off the upper die 10 and also includes a plurality of clean pins 50 attached thereto corresponding to locations of the tight plugs 40 on the upper die 10. During a part ejection cycle following the casting cycle, as the ejector pins 60 push against the casted cylinder head to release it from the upper die 10, the clean pins 50 run through the tight plugs 40, smashing and evacuating tar buildup 70 collected inside the walls of the tight plugs, illustrated in FIG. 4. The clean pins 50 clean out tar 70 from the tight plugs 40 automatically during every part ejection cycle. The clean pins 50 ensure the passages of the tight plugs 40 are clear of tar for every casting cycle which allows proper core gas venting through the upper die 10. Whereas previously the tar removed by the clean pins collected in the tar collection box (not shown), the smashed tar particles 70 shown in FIG. 2 according to the present invention fall onto the cylinder head, which is subsequently cleaned. In an exemplary embodiment illustrated in FIGS. 2 and 3, the ejector plate 30 has three clean pins 50 attached to it. However, the ejector plate 30 may have more or less than three clean pins, depending on the configuration of the upper die 10 and the specific type of cylinder head being cast.

As a result of the clean pins, tar collects only on the top surface of the cast cylinder heads. This reduces tar build-up on the clean pins 50, allowing the tight plugs 40 to effectively vent out core gases.

As illustrated in FIG. 5, the clean pin 50 is a cylindrical rod and is provided with a succession of stepped portions 51 of decreasing diameter along a longitudinal axis A of the clean pin 50, resulting in the clean pin having a funnel or pyramid shape. The clean pin 50 requires the funnel shaped geometry to be able to clean and put adequate force on the tar 70 built up in the tight plug passages 40. The geometry of the clean pin 50 allows the tar to be compressed during the downward movement of the clean pin 50 during the part ejection stroke.

A clean pin head 52 is located at one end of the clean pin 50 along the longitudinal axis A. At least two stepped portions 51 are required for the clean pin. An embodiment of the present invention includes four stepped portions 51. More than four stepped portions 51 may also be used. Each stepped portion 51 includes a chamfer 53 at an end of the stepped portion 51 furthest from the head 52 such that there is a smooth connection between two adjacent stepped portions. Preferably, the chamfer 53 is at an angle between 15 and 30 degrees from the axis A.

The material used for the clean pin 50 of the present invention is H-13 steel, which is also the same material as the dies 10, 20 and the tight plugs 40. H-13 steel is commonly used as a tooling material used in die casting for casting aluminum alloys, especially for part designs with critical features and/or if high production runs are employed. H-13 steel yields a higher resistance to heat checking, cracking and die wear caused by the thermal shock associated with the die casting process. However, other materials suitable as tooling materials may be used for the clean pins.

Prior to installation in the apparatus 1, the clean pins 50 undergo a heat treatment in order to harden the clean pin 50. The heat treatment may be a T6 heat treatment or the like. After undergoing the heat treatments, the clean pins 50 have a smooth surface and a hardness of HRC 42-45. Additionally, after the heat treatment, the clean pins 50 are also subjected to a nitride treatment to harden the outside surface of the clean pins 50 to improve wear resistance. In an exemplary embodiment, the nitride layer on the surface of the clean pins 50 has a hardness of at least HV700.

After undergoing the heat treatments and nitriding processes, the clean pins 50 are fixedly attached to the ejector plate 30 through a counter bore hole 31 made in the ejector plate 30 corresponding to each clean pin 50. The clean pin head 52 fits in the pocket 32 of the hole and a lid (not shown) holds the clean pins 50 in place in the pocket 32. The clean pins 50 have a length of approximately 250 mm. In a preferred embodiment, the clean pins 50 are pushed downwards approximately 50 mm from the top to the bottom of the part ejection stroke. As a result of the heat treatments and the nitriding treatments, the clean pins 50 are durable and have a long life in the absence of a machine or process malfunction in the overall apparatus 1.

A tight plug 40 into which the clean pins 50 lower into during the part ejection stroke is illustrated in FIG. 6*a*. Inner walls 42 of the tight plug are shown in broken lines in FIGS. 6*a* and 6*b*. The clean pins 50 and tight plugs 40 require matching geometry to successfully smash and evacuate tar buildup 70 from inside the upper die 10. Thus, the tight plugs 40 are also roughly funnel-shaped. A tight plug fastener 41 as shown in FIG. 6*b* is used to fasten the tight plug 40 to the upper die 10. In an exemplary embodiment, a portion of the tight plug 40 protrudes from the bottom portion of the upper die 10 in order to sufficiently allow the core gas to vent out of the tight plug 40. Further, the protrusion of the tight plug 40 provides a sealing surface on the casting core and prevents molten metal that is rising towards the upper die 10 during the casting cycle from travelling upwards through the tight plug 40. The amount of the protrusion is approximately 10 mm in an exemplary embodiment. The clearance between the tight plug 40 and the clean pin 50 during the part ejection cycle is preferably 1-2 mm. A clearance of 1.5 mm is optimal. While the core gas is venting, the clearance between the tight plugs 40 and the clean pins 50 allows gas to vent out without clogging up the tight plugs 40. If the clearance is less than 1 mm, the core gas attempting to evacuate through the tight plugs 40 during the casting cycle will condense into tar 70 on the inner 42 walls of the tight plugs 40 and the outer surface of the clean pins 50 due to insufficient venting clearance. If the clearance exceeds 2 mm, the tight plugs 40 cannot be sufficiently cleaned of tar 70 by the clean pins 50 in order to prevent surface defects on the cylinder head.

EXAMPLE

An example of the present invention is presented below by way of illustration without intent to limit the scope of the claimed invention.

A clean pin was machined using H13 steel containing four stepped portions. The first stepped portion including a chamfered edge had a length of 136.60 mm and a diameter (thickness) of 17 mm. The second stepped portion including a chamfered edge had a length of 37.1 mm and a thickness of 15 mm. The third stepped portion including a chamfered edge had a length of 27.73 mm and a thickness of 9 mm. The fourth stepped portion including a chamfered edge had a length of 43.97 mm and a thickness of 7 mm. Each of the lengths and thicknesses of the stepped portions had tolerances of 0.10 mm. The ends of the stepped portions were chamfered at 15 degrees. The clean pin head had a thickness of 24 mm and a length of 7 mm. The overall length of the clean pin was 252.4 mm. The heat treatment was a T6 treatment and the nitride treatment was a HV 700 treatment.

Numerous modifications and variations of the present invention are possible in light of the above teachings. It is therefore to be understood that within the scope of the appended claims, the invention may be practiced otherwise than as specifically described herein.

The invention claimed is:

1. An apparatus for core gas removal in a low-pressure cylinder head die casting operation, the apparatus comprising:

an upper die;

a lower die;

an ejector plate disposed above the upper die to eject a part that has been casted;

a plurality of tight plugs fastened into cavities formed in the upper die, the tight plugs protruding from the upper die by approximately 10 mm to provide a sealing surface with a casting core so as to prevent molten metal from traveling through the tight plugs; and a plurality of clean pins attached to the ejector plate, each clean pin corresponding to a location of one of the tight plugs, wherein the clean pins and the tight plugs have matching geometries, the ejector plate lowers to eject a casted cylinder head from the upper die such that a portion of the clean pins extend axially into the tight plugs to clean core gas residue formed on inner walls of the tight plugs during a casting cycle, and sides of the clean pins have a clearance of 1-2 mm from the inner walls of the tight plugs when the clean pins are lowered into the tight plugs.

2. The apparatus according to claim 1, wherein each of the clean pins includes:

a clean pin body including a succession of at least two cylindrical stepped portions, such that the stepped portions are arranged in order of decreasing diameter along a longitudinal axis of the clean pin; and a circular plate-shaped head arranged along the longitudinal axis at an end of the cylinder adjacent to a stepped portion having a largest diameter.

3. The apparatus according to claim 2, wherein sides of the clean pins have a clearance of 1.5 mm from the inner walls of the tight plugs when the clean pins are lowered into the tight plugs.

4. The apparatus according to claim 2, wherein the clean pins are made of metal.

5. The apparatus according to claim 4, wherein the clean pins are made of steel.

6. The apparatus according to claim 5, wherein the clean pins are made of H-13 steel.

7. The apparatus according to claim 4, wherein the clean pins have a hardness of HRC 42-45.

8. The apparatus according to claim 4, wherein the clean pins are coated with a nitride layer such that a hardness of the nitride layer is at least HV 700.

9. The apparatus according to claim 2, wherein the clean pins are funnel-shaped.

10. The apparatus according to claim 2, wherein the cylinder includes four stepped portions.

11. The apparatus according to claim 2, wherein the stepped portions have equal lengths.

12. The apparatus according to claim 10, wherein at least two of the stepped portions have different lengths.

13. The apparatus according to claim 2, wherein each of the stepped portions have different lengths.

14. The apparatus according to claim 10, wherein each of the stepped portions have different lengths.

15. The apparatus according to claim 2, wherein an end of each stepped portion furthest away from the clean pin head is chamfered and an angle of the chamfer is 15-30 degrees.

16. The apparatus according to claim 1, wherein the ejector plate includes a plurality of ejector pins, the ejector pins having a geometry different from a geometry of the clean pins.

17. The apparatus according to claim 1, wherein the ejector plate lowers to eject the casted cylinder head from the upper die such that the clean pins, during every part ejection cycle, extend axially into the tight plugs to clean the core gas residue formed on the inner walls of the tight plugs during each casting cycle, so as to cause the core gas residue to fall onto the casted cylinder head during every part ejection cycle.

* * * * *